US006218788B1

(12) United States Patent
Chen et al.

(10) Patent No.: US 6,218,788 B1
(45) Date of Patent: Apr. 17, 2001

(54) FLOATING IC DRIVEN DIMMING BALLAST

(75) Inventors: Timothy Chen, Germantown, TN (US); Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/378,193

(22) Filed: Aug. 20, 1999

(51) Int. Cl.[7] ..... H05B 41/14

(52) U.S. Cl. ..... 315/225; 315/224; 315/307; 315/244

(58) Field of Search ..... 315/209 R, 219, 315/224, 225, 244, 247, 291, 307, 308, 360, DIG. 4, DIG. 5, 207

(56) References Cited

U.S. PATENT DOCUMENTS

| | | | |
|---|---|---|---|
| 4,189,661 | 2/1980 | Haugsjaa et al. | 315/39 |
| 4,249,111 | 2/1981 | Gluck | 315/360 |
| 4,382,212 | 5/1983 | Bay | 315/225 |
| 5,173,643 | 12/1992 | Sullivan et al. | 315/276 |
| 5,291,100 | 3/1994 | Wood | 315/136 |
| 5,315,214 | 5/1994 | Lesea | 315/209 R |
| 5,373,217 | 12/1994 | Gregor | 315/248 |
| 5,561,351 | 10/1996 | Vrionis et al. | 315/248 |
| 5,744,912 | 4/1998 | So | 315/127 |
| 5,751,115 * | 5/1998 | Jayaraman et al. | 315/225 |
| 5,841,239 | 11/1998 | Sullivan et al. | 315/219 |
| 5,850,127 | 12/1998 | Zhu et al. | 315/307 |
| 5,864,212 | 1/1999 | Sullivan | 315/205 |
| 6,008,593 * | 12/1999 | Ribarich | 315/244 |

* cited by examiner

*Primary Examiner*—Don Wong
*Assistant Examiner*—Wilson Lee
(74) *Attorney, Agent, or Firm*—Fay, Sharpe, Fagan, Minnich & McKee, LLP

(57) ABSTRACT

Ballast circuit 10 for lamp 52 has a switching network consisting of a complimentary pair of switches 30, 32 which are driven by a low-power universally available controller IC 26. The controller IC 26 is configured with a floating ground arrangement 36. A current sensor 72 assists in generating a negative feedback signal 79 which is provided to an inverting input of operational amplifier 86 of controller IC 26. Prior to being supplied, the negative feedback signal 79 is summed at summing node 80 with a level shifted signal 92, generated by a level shifting circuit 22 which received an input dimming signal 16. The level shifting circuit 22 shifts the dimming signal 16 from a ground reference system to a floating ground design. The level shifted signal 92 and feedback signal 79 are designed to cancel each other whereby the input to operational amplifier 86 is maintained constant as the non-inverting input has a constant internally supplied voltage.

19 Claims, 4 Drawing Sheets

FLOATING IC DRIVEN DIMMING BALLAST

FIELD OF INVENTION

The present invention relates to a ballast, or power supply circuit, for gas discharge lamps of the type using regenerative gate-drive circuitry to control a pair of serially connected, complementary conduction-type switches of a d.c.-a.c. inverter. More particularly, the invention relates to directly driving switches using a single low-voltage integrated circuit configured with a floating ground design.

BACKGROUND OF THE INVENTION

Phase-controlled dimmable ballasts have gained a growing popularity in industry due to their capability for use with photo cells, motion detectors and standard wall dimmers.

Dimming of fluorescent lamps with class D converters is accomplished by either regulating the lamp current, or regulating the average current feeding the inverter. For cold cathode fluorescent lamps (CCFLs), the pulse width modulating (PWM) technique is commonly used to expand a dimming range. The technique pulses the CCFLs at full rated lamp current thereby modulating intensity by varying the percentage of time the lamp is operating at full-rated current. Such a system can operate with a closed loop or an open loop system. The technique is simple, low cost, and a fixed frequency operation, however, it is not easily adapted to hot cathode fluorescent lamps. For proper dimming of hot cathode lamps, the cathode heating needs to be increased, as light intensity is reduced. If inadequate heating exists, cathode sputtering increases as the lamp is dimmed. Also, the lamp arc crest factor should be less than 1.7 for most dimming ranges, in order to maintain the rated lamp life. The higher the crest factor, the shorter will be the life of the lamp. The PWM method does not address these problems, and therefore so far has been limited to CCFL applications.

Class D inverter topology with variable frequency dimming has been widely accepted by lighting industry for use as preheat, ignition and dimming of a lamp. The benefits of such a topology include, but is not limited to (i) ease of implementing programmable starting sequences which extend lamp life; (ii) simplification of lamp network design; (iii) low cost to increase lamp cathode heating as the lamp is dimmed; (iv) obtainable low lamp arc crest factor; (v) ease of regulating the lamp power by either regulating the lamp current or the average current feeding the inverter; and (vi) zero voltage switching can be maintained by operating the switching frequency above the resonant frequency of the inverter.

Conventional class D circuits which are used for d.c.—to—d.c. converters or electronic ballasts, implement a two-pole active switch via two, n-channel devices or n-p-channel complementary pairs. A gate is voltage controllable from a control-integrated circuit (IC), which is normally referenced to ground, thus, the control signals have to be level shifted to the source of the high-side power device, which, in class D applications, swings between two rails of the circuit. The techniques presently used to perform this function are by either, transformer coupling or a high-voltage integrated circuit (HVIC) with a boot-strapped, high side driver. Either solution imposes a severe cost and performance penalty.

For transformer coupling, the transformer needs to have at least three isolated windings wound on a single core, adding to cost and space considerations. The windings need to be properly isolated to prevent breakdown due to the presence of high potential. Also, the gate's drive circuit needs to be damped and clamped to prevent ringing between leakage inductors of the transformer and parasitic capacitors of switching MOSFETs.

In the case of high-voltage integrated circuits (HVIC), the HVIC has two isolated output buffers and logic circuitry which is sensitive to negative transients. The high-voltage process for the IC increases the size of the silicon die, and the boot-strap components add to the part count and costs. Such a system is also severely limited as to the switching frequency obtainable, which commonly is less than 100K Hz. Consequently, it uses the large sizes of EMI filters and resonant components and requires larger space for implementation.

In incandescent lamp dimming systems, dimming is controlled by a phase dimmer, also known as a triac dimmer. A common type of phase dimmer, blocks a portion of each positive or negative half cycle immediately after the zero crossing of the voltage. The clipped waveform carries both the power and dimming signal to the loads. The dimmer replaces a wall switch which is installed in series with a power line.

It would be desirable to use existing phase dimmer signals for dimming of compact fluorescent lamps (CFL). It would also be desirable to have such a system use a single-stage design for dimming and interfacing with a phase dimmer, provided at a low cost, with a direct gate drive for both high and low side MOSFET switches, with minimal voltage and current stresses on a resonant circuit. Still a further desirable aspect is to have a circuit which would allow programmable starting sequences to extend a lamp life, allow for low lamp arc crest factors and zero voltage switching over wide ranges. Such a system should also include compact size with low component counts and be easily adapted for different line input voltage and powers and provide for adequate protection for abnormal operations. The present invention provides the foregoing advantages, as well as others.

SUMMARY OF THE INVENTION

In an embodiment of the present invention, a dimmable ballast circuit is designed to receive a phase dimmer signal to control output of a fluorescent lamp, the dimming ballast includes an input section configured to receive the phase dimmer signal. The system includes a low cost integrated chip having an internal operational amplifier with a non-inverting input tied to a steady-state input within the integrated chip, a totem pole output. The IC is also configured in a floating ground arrangement. A coupling capacitor is connected at one end of the output of the controller IC. A switching network is designed with a pair of complementary connected switches, and is also connected to receive the output from the IC through a second end of the coupling capacitor. A current-sensing resistor is used to sense the switching current of a power switch in order to generate a feedback signal. A level shifter is designed to receive a signal from the input section, and to shift the received signal from a level of the reference ground to a level of the floating ground, the level shifted signal and the feedback signal are summed, and the summed signal is supplied to the inverting input of the integrated chip. In this manner, an error signal, the difference between two signals, is supplied to the inverting input, thereby adjusting output of the operational amplifier to regulate the output of the light level.

DETAILED DESCRIPTION OF THE INVENTION

Figure 1:
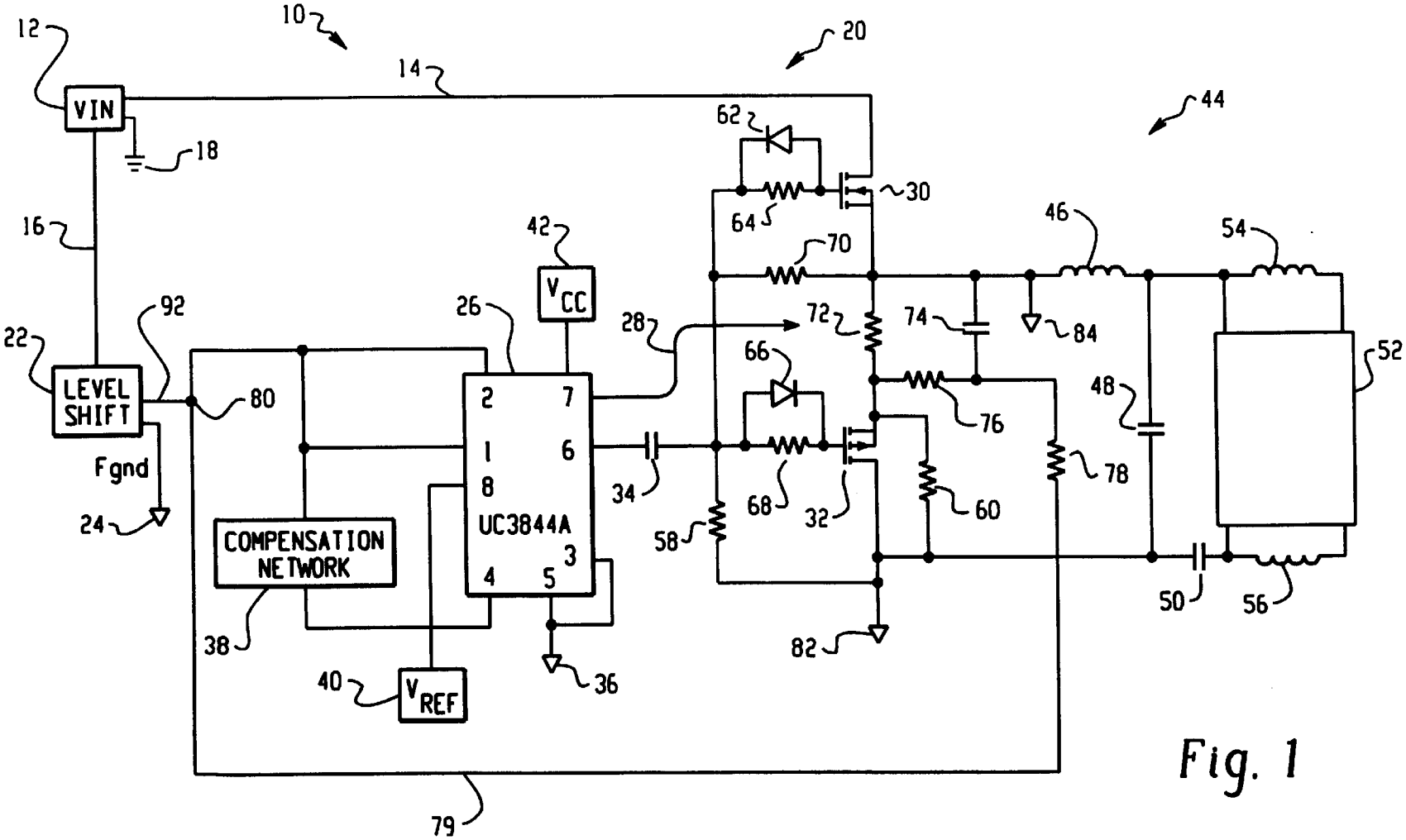
FIG. 1 is a somewhat simplified depiction of a ballast incorporating the concepts of the present invention.

FIG. 1 shows a floating IC-driven ballast 10 of the present invention. An input voltage source 12 generates a bus voltage 14, and a phase dimmer signal 16. Input voltage source 12 has a circuit ground reference 18. Bus voltage 14 is provided to a switching network 20, and phase dimmer signal 16 is provided to a level shifting circuit 22 having a floating ground reference 24. A controller integrated circuit (IC) 26, such as a current mode pulse width modulated (PWM) controller IC, delivers a gate drive 28 to switches 30 and 32 through the coupling capacitor 34. In the present embodiment switches 30, 32 may be configured as a complementary pair of MOSFETs, with switch 30 being a n-channel MOSFET and switch 32 being a p-channel MOSFET. Controller IC 26 is configured with a floating ground 36, and is supplied with a compensation network 38 and a reference voltage 40. The IC 26 is powered by a signal from a voltage source 42. Phase dimmer signal 16 is therefore a chopped input voltage which is shifted from circuit ground to a floating signal ground.

Switching network 20 delivers signals to a load circuit 44 having a series resonant configuration including resonant inductor 46 in series with resonant capacitor 48. Matching capacitor 50 is provided for low bus applications in order to maintain sufficient voltage as lamp 52 is dimmed, with the lamp cathodes heating being powered through windings 54 and 56. Lamp 52 may, in one embodiment, be a compact fluorescent lamp.

Resistors 58 and 60, 138 and 142 work in conjunction with voltage source 42 in order to ensure proper start-up of controller IC 26. The parallel combinations of diode 62, resistor 64 and diode 66, resistor 68 provides sufficient dead time to complementary switches 30 and 32, respectively. Resistor 70 works in conjunction with capacitor 34 to convert the pulse DC output of the IC 26 to an AC square waveform through diode 62, resistors 64, 68, and diode 66 in order to drive the switches 30 and 32. The network of capacitor 74 and resistors 76 and 78 function as a low pass filter to provide an average current feedback signal 79, based on the output of current sense resistor 72, so as to provide current feedback signal 79 to summing node 80.

Switching network 20 has a common to ground 82, and the center point between switch 30 and switch 32 is at a floating ground 84.

Figure 2:
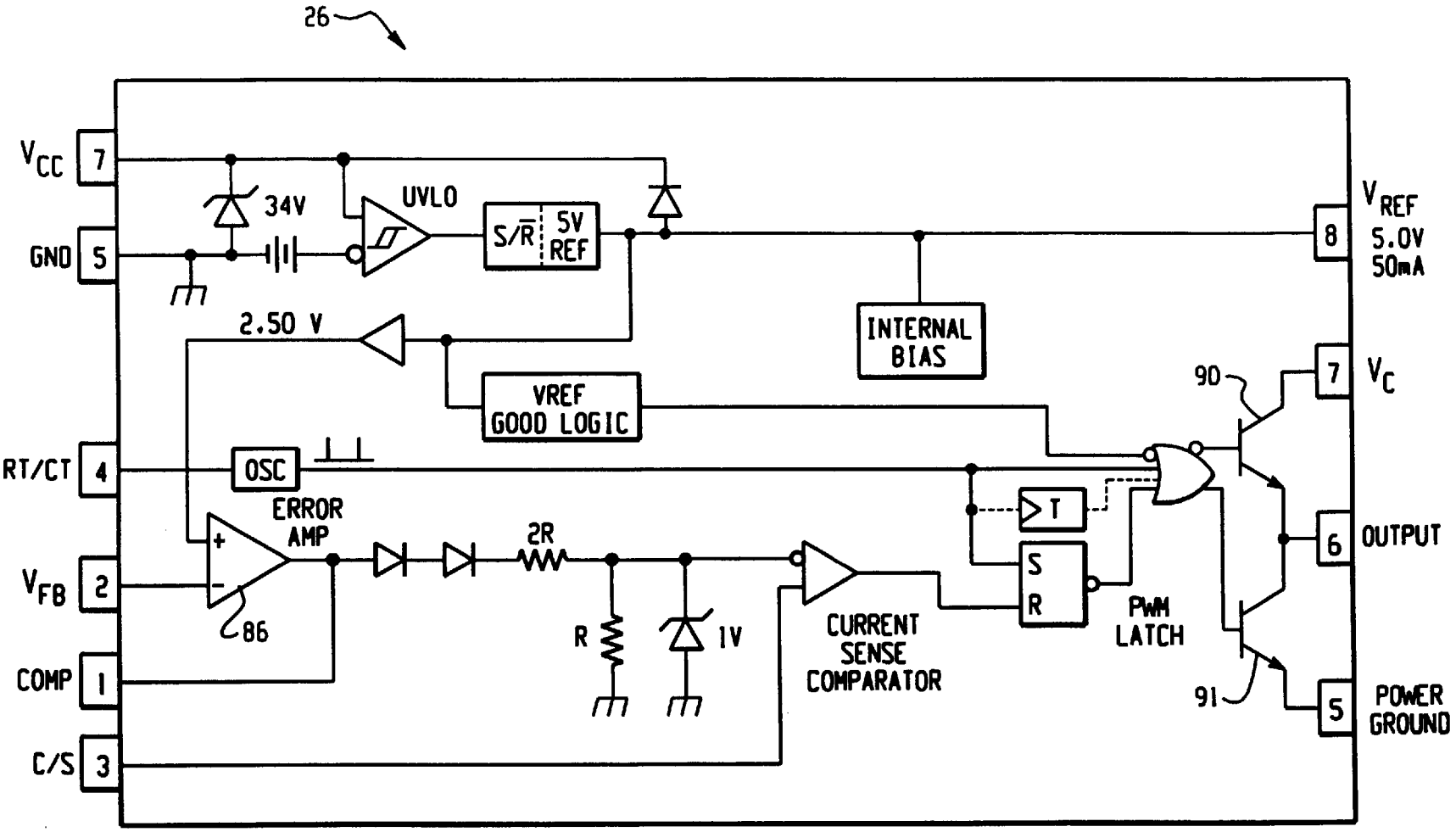
FIG. 2 is a block diagram of a IC of the type used in one embodiment of the present invention.

Further in the preferred embodiment of the present invention, controller IC 26 is designed, as shown in FIG. 2, with an internal operational amplifier or error amplifier 86 having a non-inverting output tied to a bias voltage of 2.5 volts, although other bias voltages are possible. Therefore, only the inverting input of amplifier 86 is available for use. Additionally, output 6 of controller IC 26 has two transistors 90, 91 arranged in a totem pole configuration. Therefore, the totem pole, "class D", output configuration of controller IC 26 drives a class D switching network 20, whereby the present invention is designed as a cascaded driving configuration.

A controller IC as shown in FIG. 2 is well known in the art and therefore only selected portions of its structure and operation will be discussed. An IC of the type which may be used in this embodiment includes the UC3844A, as well as the UC1842A/3A/4A/5A and UC3842/314/5 families of controller ICs, sold by Unitrode Integrated Circuits of Merrimack, N.H.

Whereas the potential of circuit ground such as circuit grounds 18 and 82 are unchanging, the potential of a floating ground, such as 24, 36 and 84, are constantly changing with reference to the circuit grounds. Thus, when switch 32 is turned on, floating ground 84 will be moved to circuit ground. However, when switch 30 is turned on, floating ground 84 will become substantially equivalent to the bus voltage value 14. Further, since 24 is tied to 36 and floating ground 84, controller IC 26 also varies between these levels.

Use of the floating ground configuration allows the use of a low voltage IC, such as a 35-volt IC instead of a more expensive high-voltage IC. Also, by implementing the low-voltage IC, a transformer coupling the gate drives is not necessary. Further, using the floating ground IC technique, it is possible to drive the ballast circuit into the megahertz range since power dissipation on the IC is extremely low compared to high-voltage techniques.

A challenge faced when implementing the present design of using a floating ground reference for controller IC 26, is a manner of desirably delivering dimming signal 16 to controller IC 26. This is a challenge since the floating ground value swings from ground reference to substantially the bus voltage input. In the present invention, dimming signal 16 is provided to controller IC 26 through level shifter circuit 22, which is provided with a floating ground 24, tied to the floating ground 36 of controller IC 26. By this arrangement, a signal provided from the rectified input voltage source 12, which is tied to circuit ground 18, may be shifted through resistors 122, 126, 128, 130, diode 124, Zener diode 137 and switch 32.

It is also a feature of the present invention to use controller IC 26, which has its non-inverting input of operational amplifier 86 (FIG. 2) internally connected to a DC voltage bias. Therefore, only inverting pin 2 of operational amplifier 86 is available for use. The inventors are aware that another manner of controlling lamp output would be to have a lamp current feedback signal provided to a non-inverting input and a dimming signal provided to an inverting input of an operational amplifier. In this manner, the dimming signal could be controlled and controlling of the lamp lumen output would be possible. However, as previously noted, the low-voltage chip is a mass-produced, low-cost device the use of which has economic benefits. To require a building of a specific chip would increase the economic cost of a system of configuring a ballast to drive a compact fluorescent lamp.

Therefore, the present invention further uses a technique to provide the desired output under the constraints of controller IC 26 as described herein. In particular, current sensing resistor 72 is used to obtain actual lamp system power. Capacitor 74 and resistor 76 provides the average value of the switching current when the bus voltage is fixed.

Using an average value of the bus voltage times the average value of switching current, the system power can be controlled and therefore also, the lamp lumen output. It is noted that the average current of the system is that detected through transistor 72, and obtaining the average current of the bus voltage may be achieved by various known techniques. By lowering system power, light output of lamp 52 will be lowered and by increasing system power light output of lamp 52 is increased.

Using the floating ground system configuration of the present embodiment means feedback signal 79 will be a negative signal. Negative feedback signal 79 is summed with level shifted signal 92 from level shifter 22 at summing node 80. The output of summing node 80 is then provided to input pin 2 of controller IC 26. Input pin 2 is the inverting input of operational amplifier 86. By obtaining and summing the above-noted signals, the present embodiment controls the received signals such that the negative feedback signal 79 and positive level shifted signal 92 are of opposite polarities. Thus the system is controlled by the magnitude of signals which differ only by the error between the set point and the feedback signal. This operation adjusts the output of operational amplifier 86 and maintains the lumen output at a given dimming level. By providing the signals, in such a manner it is possible to use a single non-inverting input for control of the output from the controller IC 26.

The present invention uses a complimentary pair of MOSFETs driven by controller IC 26 through a.c.-coupling capacitor 34 to operate lamp 52. The driving scheme eliminates the need for a high-side driver or a pulse transformer and/or generating a negative bias gate or other driving scheme.

The present embodiment uses a sensed negative average value of the switching current from sense resistor 72 to generate feedback signal 79, to allow the use of an internal operational amplifier 86 of controller IC 26.

A further mentioned concept of the present invention is the use of level-shifting circuit 22 which shifts a chopped dimming signal 16, from a ground reference level of voltage source 12 to a floating ground signal. The shifting of this dimming signal 16 allows the input signal from level shifter 22 to be used by controller IC 26.

Figure 3:
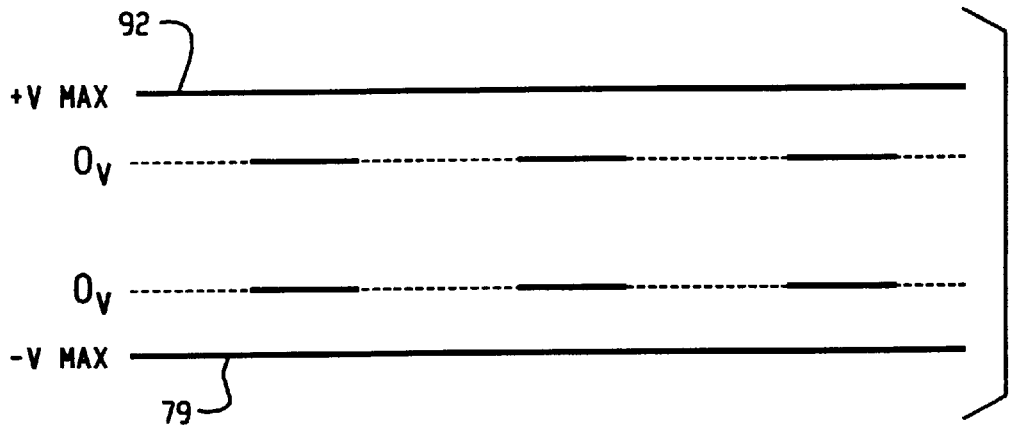
FIG. 3 depicts the level shifted signal and feedback signal which are summed.

FIG. 3 illustrates the negative feedback signal 79 obtained from sense resistor 72, and the positive level shifted signal 92 from level shifter 22. As shown, these signals are generated in a manner that they are intended to substantially cancel each other upon being summed at summing point 80 of FIG. 1. Thereby, the error between the signals is amplified and compensated. By this design, the output of operational amplifier 86 is adjusted so as to adjust the switching frequency to maintain a constant lumen level. Thus, whereas feedback signal 79 is negative going, positive going signal 92 has been level shifted for appropriate cancellation of the summed signals. The present embodiment may obtain the negative feedback signal 79 by use of a negative RMS switching current sensing procedure.

Figure 4:
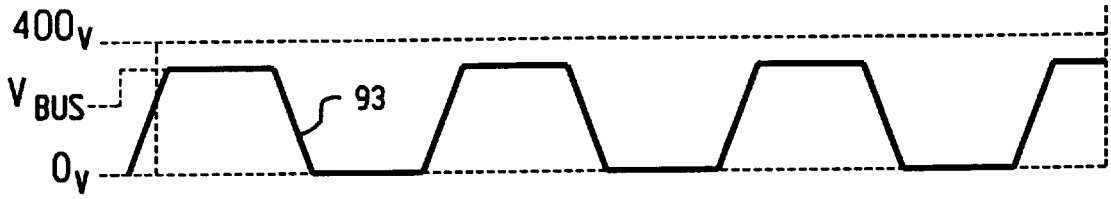
FIG. 4 is a waveform illustrating the concept of the floating ground of the present invention.

The operation of the floating ground configuration of the present embodiment is depicted in connection with FIG. 4, through quasi-square wave 93 which illustrates the potential between circuit ground to the source of switch 30. It is noted that this quasi-square wave 93 shows the source potential is flowing between a ground reference to the d.c. bus voltage. When switch 32 is turning on, the potential goes down to the circuit ground. When, on the other hand, switch 32 is turning off, the waveform reaches its upper level Vbus. This waveform illustrates the concept of floating ground of controller IC 26, since the controller IC floating ground 36 is tied to the floating ground 84.

Figure 5:
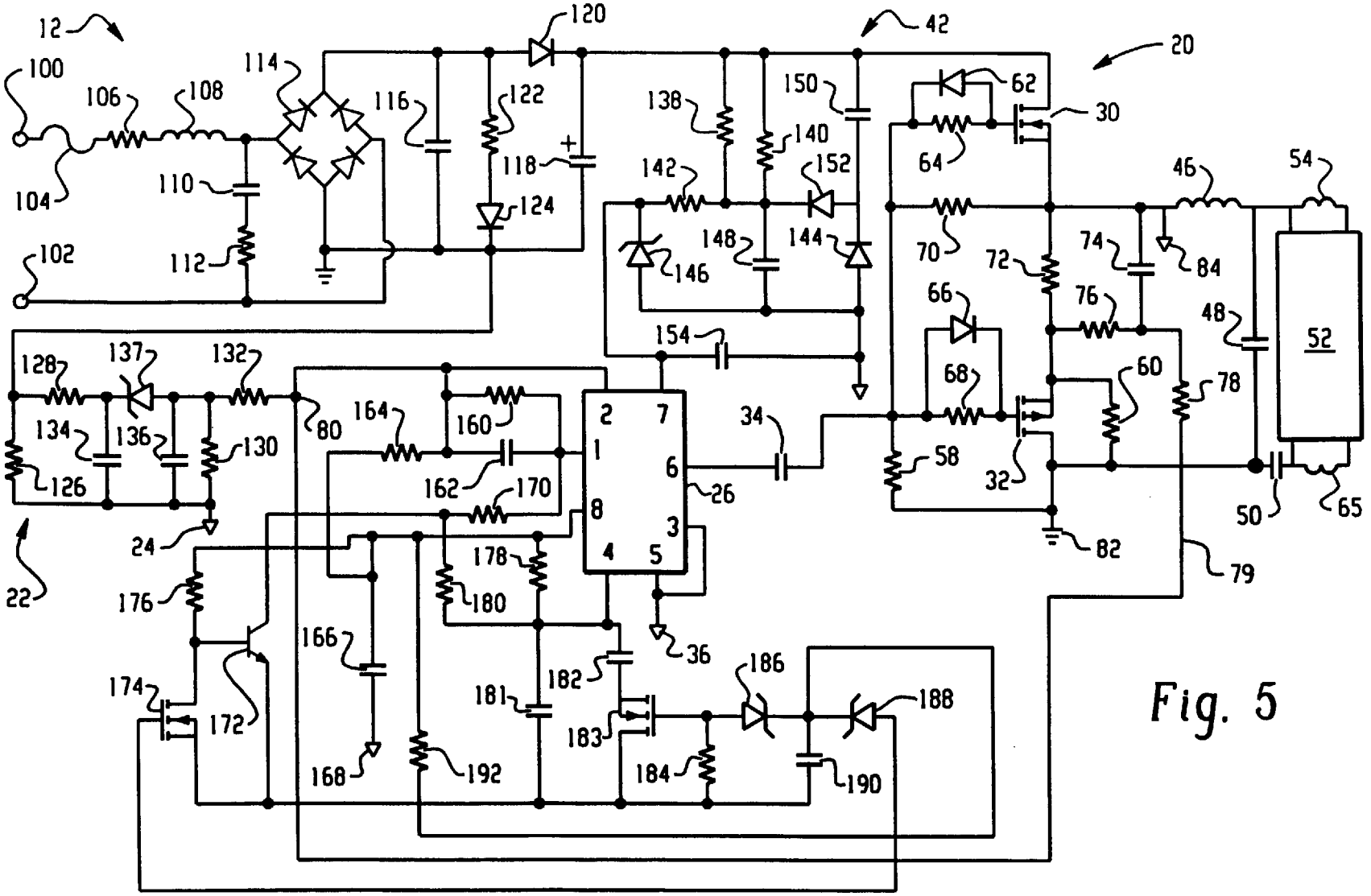
FIG. 5 is a more detailed schematic of one embodiment of the present invention.

Turning attention to FIG. 5, depicted is a more detailed schematic of the floating IC-driven dimming ballast 10 according to a preferred embodiment. For components previously mentioned, like numerals have been used for identification.

With attention to input section 12, phase dimmer output 16 is connected at inputs 100, 102. The input section includes a fusing element 104 and resistive inductive components 106 and 108, respectively. An RC network comprised of capacitor 110 and resistor element 112 are placed across the inputs of full-bridge rectifier 114. Phase dimmer input signal 16 is rectified through full-bridge rectifier 114, which may be a rectifier package, or four appropriately sized diodes. Capacitors 116 and 118 are placed on either side of blocking diode 120. The rectified phase dimmer signal 16 is supplied to level shifter circuit 22 via resistor 122 and positive-going diode 124. Use of positive-going diode 124 ensures that the signal supplied to level shifter circuit 22 is a positive signal. Level shifter circuit 22 is comprised of RC networks including resistors 126–132 in connection with capacitors 134 and 136 and switch 32. Zener diode 137 is supplied to ensure appropriate voltage levels.

Turning attention to the voltage source 42 which supplies voltage to controller IC 26, a network including parallel resistors 138 and 140, resistor 142, diodes 144, 146, capacitor 148 and resistors 58 and 60, generate the necessary voltage for starting of controller IC 26. It is noted that once controller IC 26 is charged up to an operating voltage, controller IC 26 will consume more power than can be supplied by the described start-up circuit 42. Therefore, further provided is a charge pump circuit consisting of capacitor 150, and diodes 144 and 152. Capacitor 154 is provided in connection with the VCC input, pin 7 of controller IC 26.

Remaining circuitry provides compensation for error amplifier output pin 1, the oscillation signal input pin 4, and the reference voltage pin 8, of controller IC 26. In particular, a compensation network is connected to pin 1 of controller IC 26 via a resistor 160, capacitor 162 parallel network. Capacitor 162 is connected to resistor 164 which in turn is connected to capacitor 166 tied to floating ground 168. An input side of the resistor 160, capacitor 162 parallel combination is also tied to resistor 170 which in turn is provided to a collector of NPN transistor 172, paired with FET transistor 174. It is noted a biasing resistor 176 is interconnected between the base of transistor 172 and a drain of transistor 174. The emitter of NPN transistor 172 is tied to floating ground 168. Voltage reference, pin 8 of controller IC 26 is supplied through a resistor 178, which at one end is interconnected to resistor 176 and at another end to resistor 180, input pin 4, and capacitor's 181 and 182.

Switching FET 183 has its drain connected to capacitor 182 and its source to floating ground 168. The gate of transistor 183 has a gate to source resistor 184 and oppositely positioned diodes 186 and 188. Interconnected between the oppositely positioned diodes 186 and 188 is capacitor 190, which on one end is further connected to resistor 192, while the opposite end of capacitor 190 is connected to floating ground 168. The circuit further provides connection between diode 188 and the gate of FET 174.

The above-described circuit provides a voltage-fed series resonant class D system with variable frequency, which is particularly applicable for use in compact fluorescent lamps. This topology allows easily operating in zero-voltage switching (ZVS) resonant mode, reduces the MOSFET switching losses and electrical magnetic interference. Further, by varying the switching frequency, it is possible to modulate the average current in the switching MOSFETs and therefore the output power.

The complementary pair of MOSFETs 30, 32 of the present embodiment are driven by a low-cost, single totem pole, class D, buffer output, such as a UC3844A or equivalent controller IC 26, through a.c. coupling capacitor 34. The cascade class D driving scheme eliminates the need for a high-voltage integrated chip (HVIC) or a pulse transformer and/or generating a negative gate bias. The technique is capable of providing switching frequency up to the megahertz range.

It was noted that in this application resonant feedback techniques used as an interface circuit to the phase dimmer are not included. For phase dimming, if an input EMI filter is not properly damped, it would resonate and cause misfiring of the triac dimmer, causing the lamp to flicker.

Exemplary component values and/or designations for the circuit of FIGS. 1 and 5 are as follows for a compact fluorescent lamp rated at 28 watts with a d.c. bus voltage of at least 120 volts:

| | | |
|---|---|---|
| Inductor 46 | 520 | micro-henries |
| Capacitor 48 | .0033 | farads |
| Capacitor 50 | .0047 | micro-farads |
| Resistors 58, 60 | 200K | ohms |
| Resistors 64, 68 | 1K | ohm |
| Resistor 70 | 10K | ohms |
| Resistor 72 | 5.1 | ohms |
| Capacitor 74 | .01 | micro-farads |
| Resistor 76 | 10K | ohms |
| Resistor 78 | 500K | ohms |
| Fuse 104 | 120 | volts |
| Resistor 106 | 5.1 | ohms |
| Inductor 108 | 2.5 | micro-henries |
| Capacitor 110 | .1 | micro-farads |
| Resistor 112 | 330 | ohms |
| Capacitor 116 | .047 | micro-farads |
| Capacitor 118 | 47 | micro-henries |
| Resistor 122 | 500K | ohms |
| Resistor 126 | 5.5K | ohms |
| Resistors 128, 130 | 10K | ohms |
| Resistor 132 | 500K | ohms |
| Capacitor 134 | .47 | micro-farads |
| Capacitor 136 | .01 | micro-farads |
| Resistors 138, 140 | 200K | ohms |
| Resistor 142 | 100 | ohms |
| Capacitor 148 | 22 | micro-farads |
| Capacitor 150 | 1 | nano-farad |
| Capacitor 154 | .1 | micro-farads |
| Resistors 160, 164 | 240K | ohms |
| Capacitor 162 | 10 | nano-farads |
| Capacitor 166 | .1 | micro-farads |
| Resistor 170 | 10K | ohms |
| Resistors 176, 178 | 20K | ohms |
| Resistor 180 | 40K | ohms |
| Resistor 184 | 20K | ohms |
| Capacitors 181 and 182 | 1 | nano-farad |
| Capacitor 190 | 4.7 | micro-farads |
| Resistor 192 | 500K | ohms |

In addition, MOSFET 30 is sold under the designation IRF240, MOSFET 32 under designation IRF9240, transistor 172 under designation N2222, and MOSFETS 174 and 183 under designation IRL5020. Diodes 62, 66, 144 and 152 are sold under designation 1N4148, diodes 120 and 124 under designation 1N4005, Zener diodes 137, 186, 188 under designation 1N4702 and Zener diode 146 under designation 1N4617, which are well known in the industry.

While the invention has been described with respect to specific embodiments by way of illustration, many modifications and changes will occur to those skilled in the art. It is therefore, to be understood that the appended claims are intended to cover all such modifications and changes which fall within the true spirit and scope of the invention.

What is claimed is:

1. A dimming ballast circuit designed to use a phase dimmer signal to control output of a fluorescent lamp, the dimming ballast comprising:

a controller integrated chip (IC) having an internal operational amplifier with a non-inverting input tied to a steady state voltage, and a Class D output, the controller integrated chip configured in a floating ground arrangement, and configured to generate a drive signal from the phase dimmer signal;

a switching network which receives a drive signal from the controller IC for operating the switching network, to control operation of the fluorescent lamp;

a level shifter designed to receive the phase dimmer signal from the input, and to shift the received phase dimmer signal from a level of the reference around to a level of the floating ground; and a load circuit including the fluorescent lamp, connected to a series configured resonant inductor and resonant capacitor.

2. The invention of claim 1 further including:

a feedback signal generated from current of the switching network.

3. The invention of claim 2 further including:

a summing node which sums the shifted signal of the level shifter with the feedback signal from the current sensor, such that the level shifted signal and the feedback signal are summed at the summing node, whereby the error is input to the operational amplifier.

4. The invention according to claim 1:

wherein the switching network includes a pair of switches.

5. The invention according to claim 4:

wherein the pair of switches are configured as a common source complementary pair of transistors.

6. The invention according to claim 5:

wherein gates of the common source complementary pair of transistors are driven from a single drive signal.

7. The invention according to claim 1:

wherein the fluorescent lamp is driven by a pulse width modulated signal.

8. The invention according to claim 1:

wherein the switching frequency of the ballast circuit is 100KHz or greater.

9. The invention according to claim 1 wherein the phase dimmer signal is a chopped input voltage, which is shifted from circuit ground to floating ground.

10. A dimming ballast circuit designed to receive a phase dimmer signal to control output of a fluorescent lamp, the dimming ballast comprising:

an input configured to generate the phase dimmer signal;

a controller integrated chip (IC) having an internal operation amplifier with a non-inverting input tied to a steady state voltage, within the integrated chip, and a Class D output the controller integrated chip configured in a floating ground arrangement;

a coupling capacitor connected at one end to the output of the integrated chip;

a complementary pair of power switches, wherein the gates of the switches receive the output of the integrated chip through a second end of the coupling capacitor;

a resistor connected to the second end of the coupling capacitor, and to the floating ground;

a switching current sensor which senses current of the switching network and generates a feedback signal;

a level shifter designed to receive the phase dimmer signal from the input, and to shift the received phase dimmer signal from a level of the reference ground to a level of the floating ground;

a summing node which sums the shifted signal of the level shifter with the feedback signal from the current sensor, such that the level shifted signal and the feedback signal are summed at the summing node, whereby the error is input to the operational amplifier; and a resonant network configured to receive the output from the switching network.

11. The invention according to claim 10:

wherein the complementary a pair of switches are configured as a common source complementary pair of transistors.

12. The invention according to claim 11:

wherein gates of the common source complementary pair of transistors are driven from a single drive signal.

13. The invention according to claim 10:

wherein the fluorescent lamp is driven by a pulse width modulated signal.

14. The invention according to claim 10:

wherein the switching frequency of the ballast circuit is 100 K Hz or greater.

15. The invention according to claim 11:

wherein the phase dimmer signal is a chopped input voltage, which is shifted from circuit ground to floating ground.

16. A method of controlling an output supplied to a fluorescent lamp by a ballast:

supplying a square wave signal to an input of the ballast;

configuring an integrated control chip of the ballast with a floating ground;

placing a non-inverting input of an internal operational amplifier of the integrated control chip with a steady state input;

sensing an average switching signal of a switching network of the ballast;

forming a feedback signal based on the sensed average switching current;

feeding the input signal to a level shifter circuit of the ballast;

generating a level shifted signal from the input signal feed to the level shifting circuit;

summing the feedback signal and the level shifted signal, such that the difference between the feedback signal and the level shifted signal are amplified and compensated;

supplying the summed signal to an inverting input of the operational amplifier, wherein the operational amplifier receives constant inputs on its non-inverting and inverting inputs; and energizing the fluorescent lamp via the switching network.

17. The method according to claim 16:

wherein dimming is accomplished by fixed frequency current mode controlled pulse width modulated signals.

18. The method according to claim 16 wherein:

a negative RMS switching current sensing method is used for obtaining dimming.

19. The method according to claim 16:

wherein the switching frequency is 100K Hz or greater.

* * * * *